US005497565A

United States Patent [19]

Balgin

[11] Patent Number: 5,497,565

[45] Date of Patent: Mar. 12, 1996

[54] SPIKE ASSEMBLY FOR FOOTWEAR

[76] Inventor: Lionel G. Balgin, 63 Central Ave., Albany, N.Y. 12206

[21] Appl. No.: 395,058

[22] Filed: Feb. 27, 1995

Related U.S. Application Data

[63] Continuation-in-part of Ser. No. 230,197, Apr. 20, 1994, abandoned.

[51] Int. Cl.[6] ..... A43C 15/14

[52] U.S. Cl. ..... 36/61; 36/134

[58] Field of Search ..... 36/61, 62, 134, 36/59 R, 113

[56] References Cited

U.S. PATENT DOCUMENTS

| | | | |
|---|---|---|---|
| 3,717,238 | 2/1973 | Fox | 36/61 |
| 3,793,751 | 2/1974 | Gordos | 36/61 |
| 4,375,729 | 3/1983 | Buchanon, III | 36/61 |
| 4,821,434 | 4/1989 | Chen | 36/61 |
| 4,825,562 | 5/1989 | Chuang | 36/134 |
| 4,873,774 | 10/1989 | Lafever | 36/61 |
| 5,269,080 | 12/1993 | Davis | 36/61 |
| 5,337,494 | 8/1994 | Ricker | 36/61 |

FOREIGN PATENT DOCUMENTS

| | | | |
|---|---|---|---|
| 76849 | 2/1894 | Germany | 36/61 |
| 83171 | 11/1894 | Germany | 36/61 |
| 191178 | 11/1907 | Germany | 36/61 |
| 9314664 | 8/1993 | WIPO | 36/61 |

OTHER PUBLICATIONS

Brookstone "Hard to Find Tools" Cat. T-1-95A1 ©1995 Nashua, NH.; pp. front cover, 7 and back cover.

*Primary Examiner*—Paul T. Sewell
*Assistant Examiner*—Ted Kavanaugh
*Attorney, Agent, or Firm*—Schmeiser, Olsen & Watts

[57] ABSTRACT

A projectable-retractable spike assembly for use in combination with footwear. The heel and sole of a piece of footwear encase a rotatable shaft and lock subassembly, with a motion translation (conversion) device which is used to drive a network of shafts, levers and rotatable roller bars. Several spikes depend from the roller bars and thus, are motivated to alternately roll out and downward from or upward and into the heel and sole of the footwear. The assembly may be either fabricated for strap-on wear or encased within heel-sole portions of a shoe or boot.

11 Claims, 4 Drawing Sheets

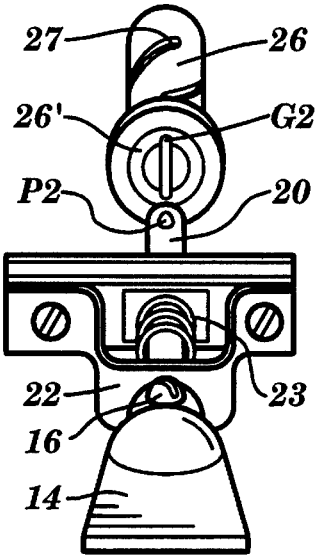
FIG. 4
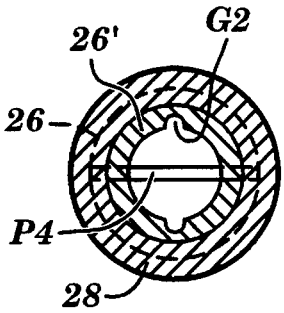
FIG. 8
FIG. 5
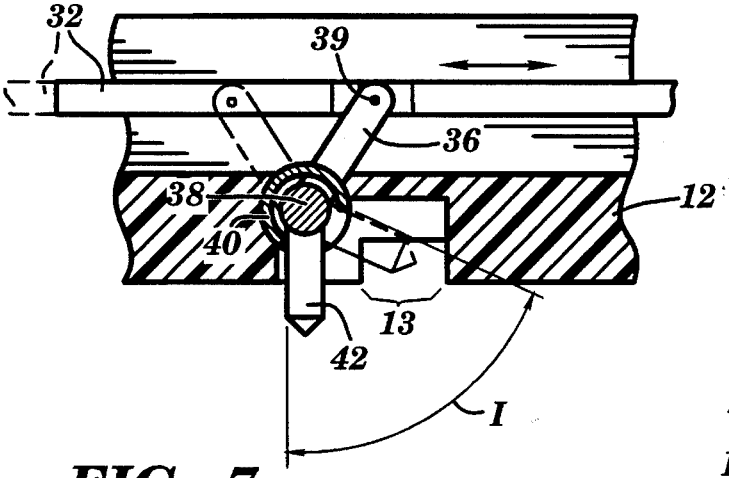
FIG. 7
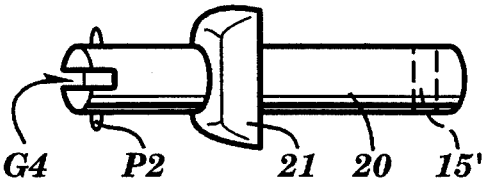
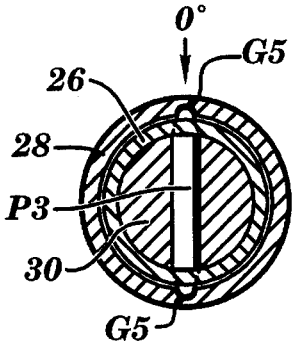
FIG. 9
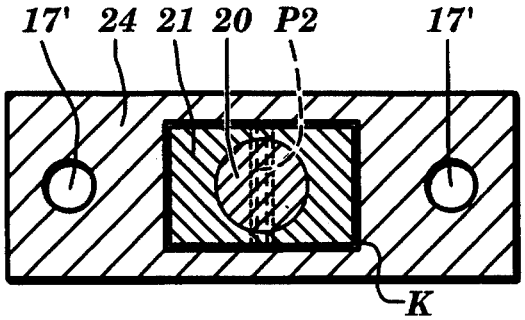
FIG. 10

SPIKE ASSEMBLY FOR FOOTWEAR

This application is a Continuation-in-Part of U.S. Ser. No. 08/230,197 filed on Apr. 20, 1994 of the same title and now abandoned.

BACKGROUND OF THE INVENTION

1. Field of the Invention

This invention relates to an assembly of extendable, or projectable, and retractable spikes for use with footwear. More specifically, in the working embodiment, an array or assembly of ground-engaging spikes is encased in the sole-heel matrix of a piece of footwear and mechanized so that the spikes may be projected from the sole-heel in a surface-contacting protrusion or retracted when their gripping facility is no longer desired.

2. Discussion of the Relevant Art

Structures similar to that described above are known in the art. The concept of a projectable and retractable anti-slip device is employed in the shoe or boot footwear associated with hiking and skiing, and could be conceivable employed in other sports such as golf. In my search for relevant art, I discovered several patents which taught purely mechanical actuation devices for projectable and retractable spikes. U.S. Pat. No. 3,793,751 discloses a retractable spike apparatus for use in a golf shoe and the like. By turning a knob which projects or protrudes from the heel of the shoe, two eccentrically mounted shafts, that are coupled by a flexible, intermediate shaft, effect a camming action that forces each of two strap-captured plates downward. The plates carry a plurality of spikes which are caused to protrude through the heel-sole portion of the shoe into ground contact. Further rotation of the camming shafts causes their retreat from the plates, allowing them to be rebiased in the upward position and withdrawn into the sole-heel ensemble. A ski boot traction device, disclosed in U.S. Pat. No. 3,717,238, teaches a retractable anti-slip spike assembly encased in a ski shoe and consisting of a tubular metal casing transversely embedded in the sole and the heel of the shoe. The casing has a longitudinally rotatable camming member mounted over a longitudinal plate element that is provided with a plurality of depending spikes which are accessible through openings in the bottom wall portion of the shoe casing. The plate member is spring-biased upwardly in order to retract the spikes while the rotatable camming member may be manually operated through use of a radial handle element which is accessible to the user. As with '751, this device utilizes at least one camming member to drive the spikes downward through a plurality of openings in the sole-heel of the boot. Still employing a camming action, but using a spike array that need not be afforded openings in the sole-heel ensemble, U.S. Pat. No. 4,375,729, for footwear having retractable spikes, employs a mechanism for selectively extending and retracting the spikes through the use of finger pressure on an enclosed heel cam extension bar. By digital manipulation, a heel locking mechanism is released and a rigid cam member is moved to a forward or rearward direction. The spikes are mounted on a resilient plate in a retracted position and the plate is superimposed by the cam member. As the cam member slides over the spike plate, individual cam portions of the upper member slide over the spike bases and push them downward, causing them to extend beneath the sole-heel plane. A great advantage of the '729 device is that the spike driving mechanism is relatively inaccessible through the base of the shoe or boot which encases the entire spike assembly.

German Patent No. 191178, issued in 1907 discloses an early attempt to translate a longitudinally disposed gang-bar by means of an articulated knuckle which is rotated by a key mechanism. Most interesting is the use of a metal framework for mounting thereon the pivotation axis of several cleats. This device was readily amenable to strap-on (the shoe) usage and in the northern United States and Canada was commonly referred to as an "ice creeper" or "ice walker". The articulated portion is restricted only to the knuckle mechanism, the gang-bars of the disclosure consisting only of fairly rigid ribbonous shafts. Straps for donning the creepers are affixed, as with all devices of this type, near heel and mid-sole portions of the frame. State-of-the art patent, U.S. Pat. No. 5,337,494 discloses a cleated shoe mechanism that is actuated to move spikes into and out of a plurality of "pits" located in the bottom of the sole. This mechanism is housed or encased in the sole-heel portion of a shoe and thus, the pits are a useful adjunct to my invention.

Finally, the Brookstone (Reg. TM) Catalog of Hard To Find Tools (Brookstone T-1-95A1; Mexico, Missouri—Copyright 1994) features a cover advertisement for strap-on "ice walkers" that are useable with low-heel dress shoes. It is clear that the removable facility is contemplated with such "strap-ons" because of nonretractability of the cleats.

In order to provide a noteworthy advancement in this field, I have devised an extensible and retractable shoe spike assembly, the spikes of which are extensible from and retractable into pits located in the firm, cast portions of the sole and heel, that is the base, of a shoe or boot. Minimizing apertures in these portions of the footwear obviates a degradation of the mechanism due to fouling by the entrance into the extension-retraction mechanism of soil, mud or other debris. On the other hand, the simple and elegant mechanization of '751 could not be ignored, nor could the fact that is it operated without the use of tools and can be readily manipulated by a youngster or a person's gloved hand. Very little technique is required in a simple rotation of a knob.

3. Incorporation by Reference

Because they disclose first of their kind mechanisms or state-of-the art, the patents U.S. Pat. No. 5,337,494 and German No. 191178 are incorporated by reference. To the extent that is discloses strap-on walking cleats, the Brookstone (Reg. TM) Catalog is also incorporated by reference.

SUMMARY OF THE INVENTION

I have devised an improved lockable, extensible and retractable shoe spike assembly that is to be housed within a footwear base having interior channeling or spatial equivalent that includes both a forward sole portion and a rearward heel portion. This assembly consists in three subassemblies: a locking subassembly; a transmission network for conveying a motivating force throughout the assembly; and, a spike movement subassembly. The locking subassembly is housed substantially in the heel portion and includes a lockable shaft, a portion of which protrudes beyond the heel margin, and to which is applied two types of force for motivating the spike movement subassembly. The first motion, a reciprocative one, is used to lock and unlock the heel-borne mechanism; while a rotational or angular force is conveyed by the shaft to a motion translation (conversion) mechanism that translates the rotational motion of the shaft to a reciprocal motion that is transmitted to the spike array. To achieve this motion translation, I have coupled the shaft to a dual cylinder mechanism, the first or outer cylinder being a fixed bushing within which the inner and hollow cylinder is allowed to rotate when driven by the shaft coupled thereto. The inner cylinder of the aforesaid duality is helically slotted, that is, it bears slots which penetrate its hull and effect at least a partial helix. A bolt, having pin protrusions or detents in opposition on one end thereof, is fitted into the inner cylinder so that the detents seat in the opposing helical slots. Thus, as the inner cylinder is rotated by the shaft coupled thereto, the bolt which occupies the core of the inner cylinder is caused to traverse a portion of that cylinder's length, thus effecting a reciprocative motion induced by the rotation or angular motion of the shaft-coupled inner cylinder.

The transmission network, receiving the translation mechanism-generated reciprocative motion (also termed force) conveys it to a plurality of pivotally mounted levers via several straight shafts. An advantage obtained by my present invention is the versatility in the type of sole into which the device can be incorporated. Many types of footwear have a highly flexible sole which do not interface well with other inventions for providing retractable retrusion. My invention, however, uses multiple short straight shafts, which are hingedly connected by link pins. This configuration, as well as the placement of the connectors at the major flex points of the sole, enable my invention to function properly without significantly inhibiting the normal flex of the sole. I have, therefore, located four link pins in the half of the sole closest to the toe portion of the sole, where most flexing takes place. The levers are fixed to a series of roller bars which act as rotatable fulcrums because they are mounted in respective fixed tubular bushings. The roller bars are positioned in the heel and sole portions of the footwear base so that only incremental portions of their surfaces are exposed outside the heel and sole, and then only through a plurality of shallow depressions or pit areas in the base. When a reciprocative force is applied to the pivotal drive levers of the roller bars, the exposed increments effect an orthogonal or 90° rotation, which is described simply as forward and down or rearward and up. In each of these incrementally exposed areas of the roller bar are inserted a respective number of threadably removable and replaceable spikes. Thus, the only spring biasing which I employ is that which allows me to lock and unlock the rotatable shaft. Thereafter, rotational motion applied to the shaft will extend or retract the spikes in a most positive and secure manner. Irrespective of the spike disposition, spring biasing will return the rotatable operating shaft to a locked position and the spikes, in whatever mode, will be secured.

The base is, in the preferred form, a casting of a firm, durable substance such as rubber. Alternatively, it is a strong frame-work, both articulable and of a strap-on construction; it may be made of metal.

BRIEF DESCRIPTION OF THE DRAWINGS

FIG. 4 is a partially exploded view of selected portions of the invention;

FIG. 5 is an elevational section of FIG. 1 showing a spike mechanism;

FIG. 7 is an isometric view of the operating shaft and key;

FIG. 8 is an end sectional view of the inner cylinder and associated mechanism as seen from 8—8 of FIG. 2;

FIG. 9 is a rear sectional view of the dual cylinder apparatus looking forward from pin P3; and FIG. 10 is a sectional view of the locking mechanism as seen from 10—10 of FIG. 2.

DETAILED DESCRIPTION OF THE PREFERRED EMBODIMENT

Before presenting the details of my invention, I would first make the following definition of terms: "footwear base" shall mean the ground-contacting part of a strap-on cleat frame, shoe, boot, etc., of varying thickness whether or not hollow; "encased" shall mean housed or substantially enclosed within; and, "extend" and "project" root words shall have the same connotation irrespective of grammatical usage.

Figure 1:
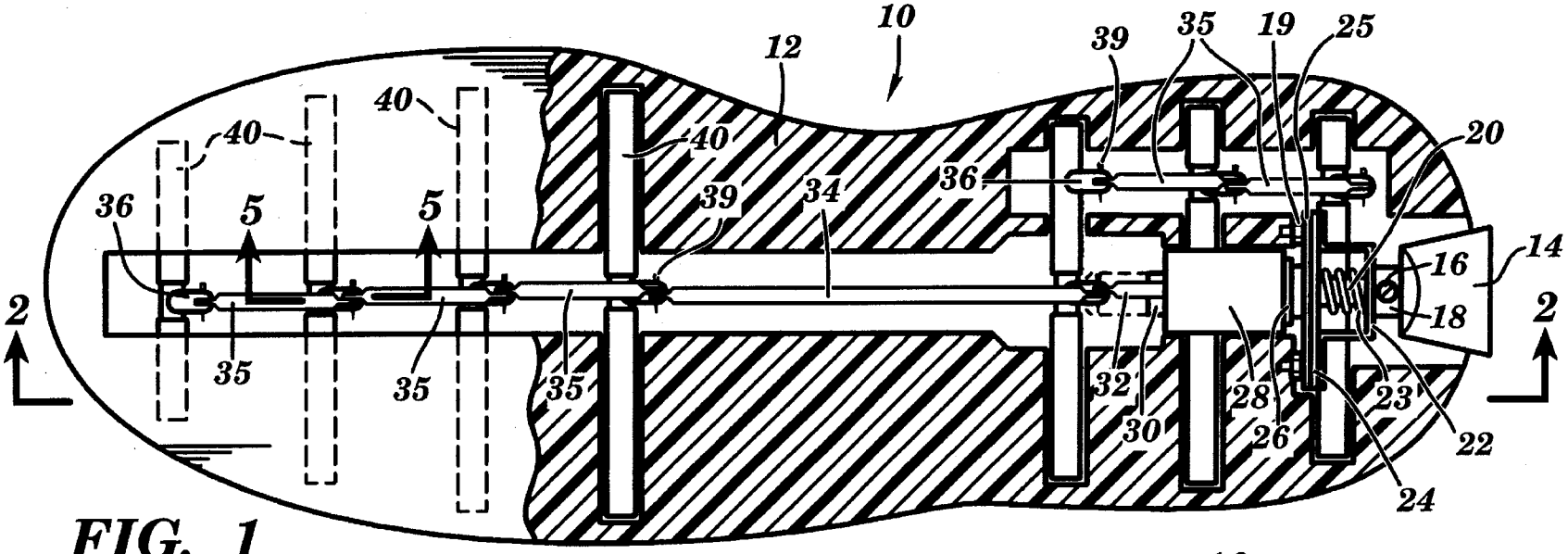
FIG. 1 is a top plan of the invention partially sectionalized and in the preferred form.
Figure 2:
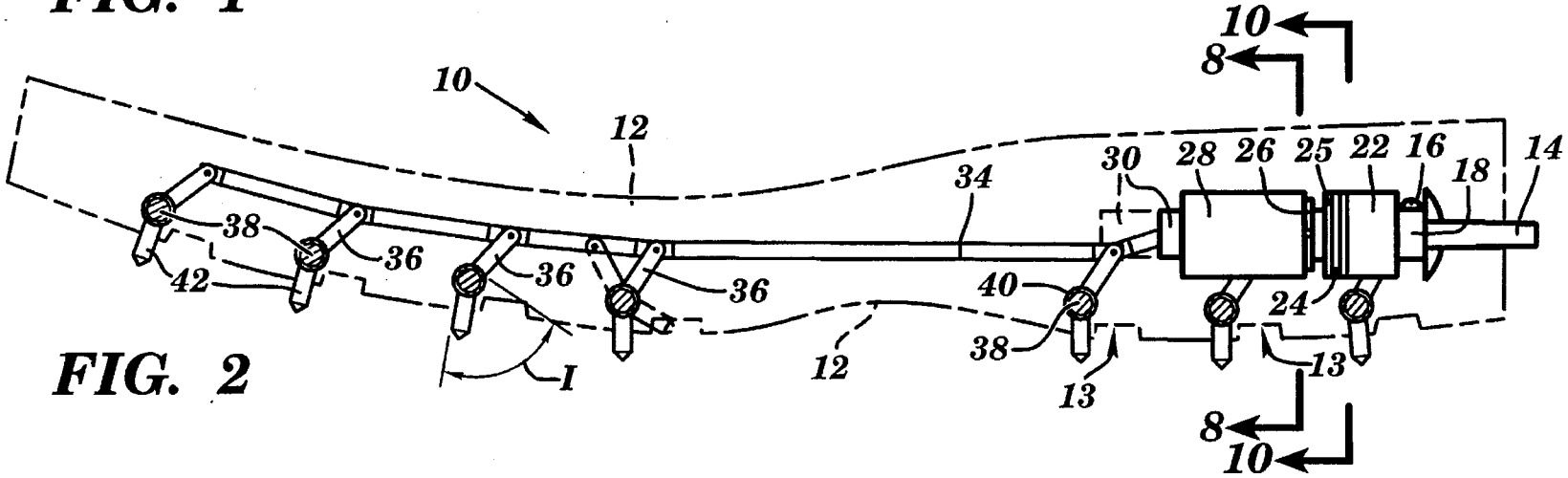
FIG. 2 is a side elevation of the invention within the (phantom) confines of the base.

Referring now to FIG. 1, the invention 10 is shown in plan, encased in a footwear base 12, which is preferably cast but may consist in a covered frame of say, high density plastic or metal. I will not digress into means for making the footwear base since a great deal is already known in the art or/and incorporated by reference. Locking and transmission subassemblies are situated predominantly in the heel portion of the base, the parts thereof being now disclosed sequentially beginning with the mechanism actuating knob 14 with integral collar 18. The collar 18 is set on shaft 20 by means of screw 16 and passed through U bracket 22, coil spring 23, keeper plate 24 and backer plate 25 which is assembled with bolts 17 (not clearly shown) and nuts 19. The aforesaid parts, items 17 and 19–25 comprise, for the most part, the bearing unit for the shaft 20 as well as the keeper mechanism for key 21 (not shown). This keeper-bearing mechanism is permanently fixed or set into the footwear base matrix or casting. Shaft 20 exits the keeper-bearing assembly passing through bushing B1 (not itemized) into the rear portion of hollow inner cylinder 26 which, with its bushing cylinder 28, that is also firmly fixed to or set in the footwear base comprises the critical dual cylinder or cylinder pair which is fundamental to the motion translation process that I use in my invention. As will be disclosed hereinafter, the cylinder pair 26, 28, with internal mechanisms, converts the rotary motion applied to the shaft 20 to a reciprocative motion effected by bolt 30, which is inserted into the inner cylinder 26. Hereinafter, inner cylinder 26 will take on the nomenclature "slotted cylinder 26" as discussion ensues as to the internal mechanisms of this dual cylinder apparatus. To this point, the plan view of FIG. 1 has been addressed; however, the reader is urged to consider FIG. 2, an elevational view of the FIG. 1 apparatus for the remainder of this discussion concerning the overall invention assembly 10. The reciprocative motion or force effected by bolt 30 is coupled to link shaft 32 and immediately to the forwardmost spike mechanism by the link assembly LA. The connection of the link shaft 32 to both bolt 30 and link assembly LA is by way of link pins 39, seen throughout this apparatus. From linking point LA the motion and force transmission digresses to the apparatus contained in the heel and also forward in the footwear base to the sole portion. The first power take-off is at the forwardmost spike roller mechanism of the heel. Reciprocative motion derived from the bolt 30 is transferred to a pivotally connected lever 36 and from there to a roller bar 38 in which the lever 36 is firmly fixed. The roller bar 38 rotates in sleeve bushing 40, thus effecting a roller type fulcrum. Proximate one of the ends of the forwardmost heel roller assembly is another lever 36 lying in the same plane as the aforementioned lever with respect to the roller bar 38. This is the only roller bar on which two or more levers 36 are seen to appear. At this point, the remaining heel roller assembly typifies the remaining roller assembly found in the sole of the shoe: lever 36 is linked by link pin 39 to short shaft 35 which is, in turn, connected to another lever by a similar link pin 39 which motivates a second of the heel-disposed roller bar 38. By concatenating lever 36 ends with succeeding short shafts 35 via link pins 39, the aforementioned apparatus may be used to gang as many roller assemblies as required. This is clearly seen in FIGS. 1 and 2 in respect of the area forward of the heel portion, generally termed the sole portion. There, main shaft 34 duplicates the heel roller bar assembly in every respect. Referring specifically to FIG. 2, roller bars 38 residing in their tubular bushings 40 are seen in a sectional elevation taken at 2—2 of FIG. 1. The reader will note that portions of the footwear base 12 are provided cut out ports 13 which, according to a manufacture's desire, may be disposed as treads in the sole and heel of the base. As mentioned earlier, since the tubular bushings 40 are fixed to or in the footwear base, a small increment of the bushing length and arcuate surface must be opened to allow a depending spike 42 to translate between the positions shown in FIG. 2, that is between the projected or extended position shown in solid illustration and the retracted, shown in phantom. This increment is denoted by I as seen in the spike apparatus (also FIG. 3). Having described or defined, in FIGS. 1 and 2, all visible features, I will now discuss the main parts of the spike assembly apparatus with reference to the exploded illustration of FIG. 3.

Figure 3:
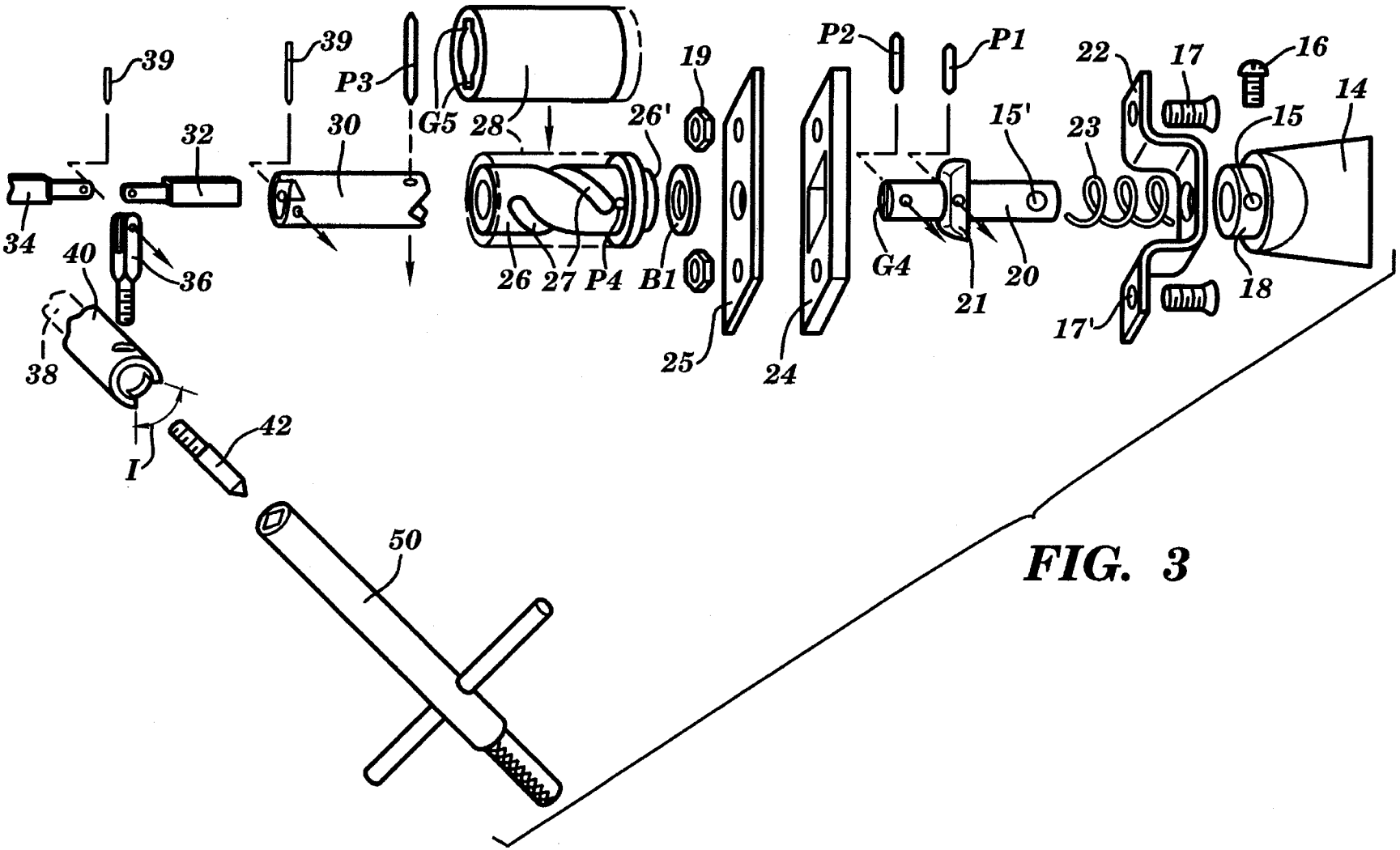
FIG. 3 is an exploded view of selected portions of the invention.

As in FIG. 1, the description in detail of FIG. 3 begins at the rearmost portion of the spike assembly apparatus beginning with knob 14 secured to rotatable shaft 20 through the collar 18 securing mechanism 15, 16. The rectangular key 21 is secured to the shaft 20 by pin P1. Pin P2 seen at the left end of shaft 20, rearward of slot G4, is placed in the shaft before any further assembly. The functions of P2 and G4 will be explained later. Using machine bolts 17, U bracket 22, biasing coil spring 23, base plate 24, retaining plate 25 and nuts 19, the locking and rotational force application subassembly is assembled as shown and fixed in the matrix of the footwear base. Bushing B1 is placed at the end of the shaft 20 which protrudes from the locking subassembly toward the left of the illustration (which is the "forward" direction of apparatus appearance). A motion translation (conversion) subassembly, consisting of a slotted 27 rotatable cylinder 26 is hollowed so that an essentially round bar 30 may slide therethrough. An outer cylinder, a bushing cylinder 28, is fitted over the slotted cylinder 26 and fixed also in the footwear matrix to act as a bushing for the slotted cylinder. The bar 30 is fitted with pin P3 at its rearmost end such that the tips of pin P3 protrude from the surface of the bar to the extent that the ends will comfortably fit into the slots 27 of the inner slotted cylinder 26. Thus, as cylinder 26 is caused to rotate in its bushing 28, the ends of pin P3, being constrained to remain in a vertical position as shown, are drawn by the helical slots 27 of cylinder 26 in reciprocative fashion to the left or right (forward or rearward) as is apparent from the illustration. At this point, the reader must realize that the sizing of parts in all illustrations are not totally accurate, but rather presented as they are for the purposes of exposition and to impart ease of understanding. Some of the minor parts and details are not herein enumerated, but will be discussed later during explanation of the remaining drawings. The leftmost portion of the FIG. 3 illustration typifies the transmission network by which the reciprocating force resulting from movement of round bar 30 is conveyed via link shaft 32 to other link shafts, main shaft 34 and to the roller bar (fulcrum) assembly 38, 40 via levers 36 and link pins 39. Finally, in the FIG. 3 illustration, a single spike 42 is shown with its apparent disposition in roller bar 38, a portion of which is exposed, as the increment I, through roller bushing 40. A spike removal/insertion tool 50 is isometrically illustrated and is self explanatory. FIG. 4 is an isometric, exploded illustration of the apparatus lying predominantly in the heel portion and is provided in order to explain the function of pin P2 and slot or groove G2. As before, the reader is cautioned not to seek accuracy in the size and shape of the elements presented herein since they are presented for illustrative purposes only. Forward of the locking and force application subassembly, rotational shaft 20 (also termed "key shaft") is slotted and pinned at its foremost end. The pin P2 has ends which protrude from the surface of the shaft 20. Cylinder 26 is either fitted with an adapting cylinder 26' or, if suitable, its interior is longitudinally grooved G2 to receive the protruding ends of pin P2. It is this pin and groove combination which allows rotational motion and force of shaft 20 to be transferred to the inner cylinder 26. The purpose for slot G4 will be understood later during the discussion of FIG. 8.

Figure 6A:
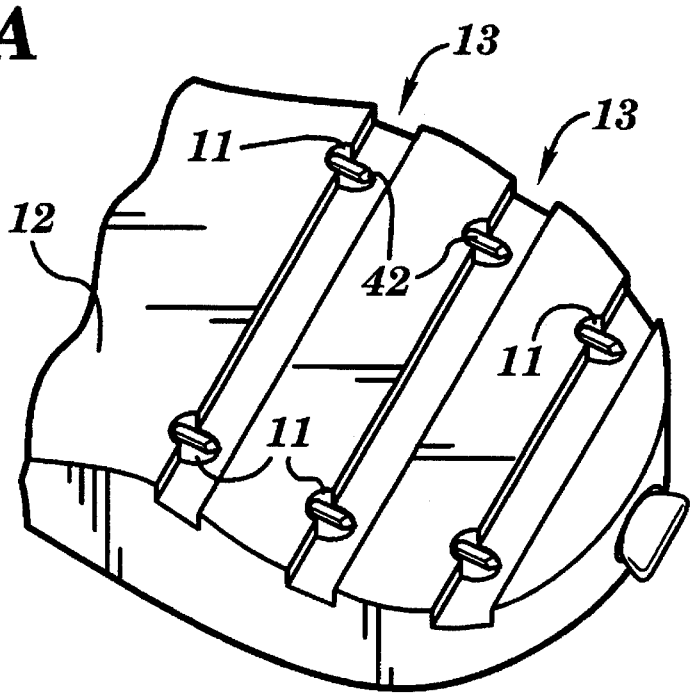
FIG. 6A is a partial isometric illustration of the heel showing spikes retracted.
Figure 6B:
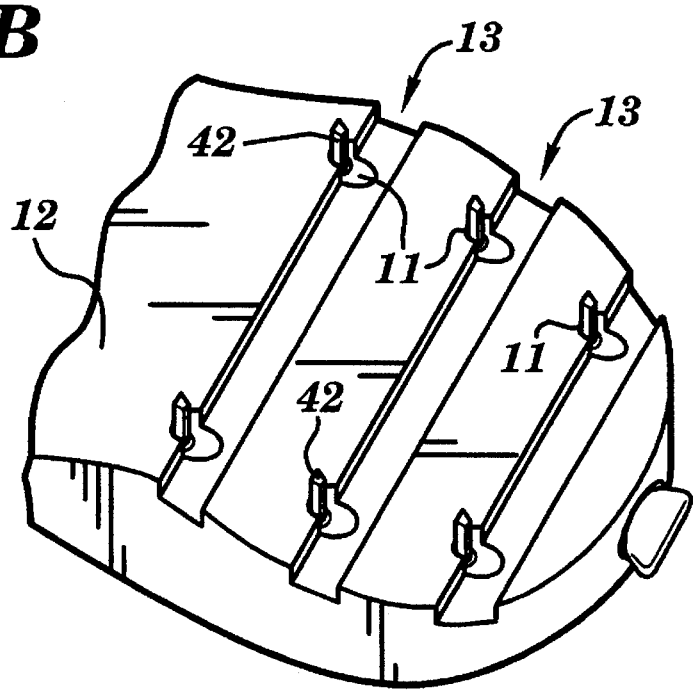
FIG. 6B is the FIG. 6A section showing spikes projected.

During the discussion of FIG. 2, there was pointed out the two positions to which the spikes of the invention may be driven. FIGS. 5, 6A and 6B carry this disclosure a bit further and the reader may readily discern the placement of parts and sections of the spike rotation apparatus as formerly enumerated. Moving to FIG. 7, there is depicted an elevational view of key shaft 20, bearing the rectangular key 21 device, pin P2 and with slot G4 and screw 16—receiving hole 15'. Whereas FIG. 1 illustrated the components to which, and with which, the FIG. 7 device was connected, FIG. 8, a cross section of the dual cylinder motion translation subassembly, better illustrates the functional relationship between the shaft 20 and itself. In FIG. 8, bushing cylinder 28 cylindrically envelopes slotted cylinder 26. An adaptive cylinder 26', integral with slotted cylinder 26 provides grooving G2 and the necessary inner diameter to accept the left end of shaft 20 as shown in FIG. 7. The exposed ends of pin fitted in grooves G2, are the primary guidance and force transfer mechanism between the shaft 20 and the inner slotted cylinder 26; the duo assure alignment between P4/G4. During locked modes of the invention, slot G4 of shaft 20 resides over and captures pin P4, which bisects and is securely fixed in slotted cylinder 26. Thus, when in a locked mode, that is, shaft 20 bearing fixed key 21 spring biased forwardly so that key 21 resides in keeper aperture K, the locking assembly securely captures pin P4 and prevents any further movement of the slotted cylinder 26. Forward of the FIG. 8 apparatus, the dual cylinder motion translation means is shown in cross section at FIG. 9. Therein, bushing cylinder 28 cylindrically envelopes slotted cylinder 26 which contains therein bolt 30. Bolt 30, transfixed by pin P3 is constrained from rotational movement by residence of pin P3 in the 0°–180° longitudinally disposed grooves G5 in bushing cylinder 28. Regressing somewhat to the locking assembly, FIG. 10, taken at 10—10 of FIG. 2, is a sectional elevation of the key and keeper device of the invention. The essential part, key 21 of shaft 20 is seen residing in keeper aperture K of keeper plate 24. The pin depicted is P2, which is superimposed illustratively over pin P1. The reader will recall that pin P2 (from FIG. 7) is a most essential device in that its communication in groove G2 of the slotted cylinder apparatus 26, 26' is necessary to assure rotational motion force transfer from shaft 20 to the slotted cylinder 26.

Although I have described my invention in a generalized footwear base, the routineer will recognize that its applications, namely the moving of a translational shaft by rotary motion is not restricted solely to the disclosed embodiments. It should also be realized that the footwear base may serve as a strap-on "ice walker" or "creeper", as well as the sub-sole or ground-contacting sole of a shoe or boot.

Having defined in detail the working embodiment of my invention, I would now commend its usage to those in the field who would apply it within the spirit of the instant disclosure. Such use is strongly encouraged by me consistent with the hereinafter appended claims.

What is claimed is:

1. A completely mechanical, lockable, extensible and retractable shoe spike assembly housed within a footwear base, said base including a forward sole portion and a rearward heel portion, said assembly comprising:

a rotatable locking subassembly encased in said heel portion and including a shaft on which is mounted a lock means, said lock means insertable into and removable from a fixed keeper means, said shaft coupled to a motion translation means for converting a rotational motion applied to said shaft to a reciprocative motion that is directed essentially parallel to a longitudinal axis common to said sole and said heel portions, said motion translation means coupled to said shaft and further comprising a helically slotted hollow cylinder residing within a cylindrical bushing and containing in longitudinal axial translative disposition therein a bolt, said bolt compelled to translate within the slotted cylinder by slidable engagement of bolt surface detents within the said helical slots;

a reciprocative motion transmission means housed substantially in said sole portion comprising drive means for receiving reciprocative force derived from said translation means and conducting said force by one or more articulated shafts to a plurality of pivotal lever means that are coupled to rotatable fulcrum means, said fulcrum means being disposed essentially transverse to said axis; and a plurality of individually removable and replaceable spike members exposable from said base and disposed in at least one of said fulcrum means substantially orthogonal to a rotational axis of said fulcrum means, whereby rotation of said shaft in an unlocked mode effects a reciprocative forward or rearward motion that is transmitted as said force through said drive means to said at least one fulcrum means causing said spike members to retract upward or project downward, respectively, relative to said base.

2. The assembly of claim 1 wherein said lock means comprises a shaft spring biased between a keeper plate and a U-bracket, said shaft having thereon a key which is removably disposable in an orifice within said plate.

3. The assembly of claim 2 wherein said keeper means is said keeper plate having therein said orifice shaped to receive therein said key in a non-rotatable posture.

4. The assembly of claim 3 wherein the footwear base is strapped to a conventional shoe.

5. The assembly of claim 3 wherein said transmission means comprises a plurality of shafts and pivotally connected levers communicating with said bolt.

6. The assembly of claim 5 wherein said fulcrum means comprises a roller bar which resides in a tubular bushing that is fixed in/to said base, said bar rotatably moveable by connection thereto of at least one said lever.

7. A rotatably projectable and retractable spike system for use in combination with footwear and comprising:

a heel and sole footwear base accommodating therein a spike assembly which effects projection of a spike plurality from out said base and retraction thereinto;

a release-lock, pull-unlock rotatable shaft mechanism coupled to a helically slotted inner cylinder of a dual cylinder means which converts an angular motion of said rotatable shaft mechanism to a reciprocative motion that is effected by a transverse pin-captured bolt, said bolt residing within said helically slotted inner cylinder and which is compelled to reciprocate by passage of ends of said transverse pin through helical slots of said inner cylinder, said rotatable shaft mechanism encased principally in said heel of said base;

transmission means for transferring said reciprocative motion to at least one lever-roller fulcrum-spike component; and said at least one component connected to said transmission means.

8. The system of claim 7 wherein said dual cylinder means comprises a first helically slotted cylinder freely rotatable within a fixed larger cylinder, said larger cylinder effecting bushing means.

9. The system of claim 8 wherein said transmission means comprises a pivotally articulated shaft in said sole, said shaft having at least three points of articulation disposed forward of said bolt, said shaft having at said at least three points of articulation, at least one said lever-roller, fulcrum-spike component.

10. In combination with and principally encased within a footwear base, a locking first rotatable shaft coupled to a dual cylinder and bolt means for converting angular force to reciprocative force, said reciprocative force effected by the bolt and conducted through at least one translatable articulated shaft to at least one pivotally connected lever, said lever fixed orthogonally to a rotatable shaft from which depends, orthogonal to said rotatable shaft, at least one removable and replaceable spike.

11. The system of claim 10 wherein said dual cylinder and bolt means for converting rotational force to reciprocative force comprises a first rotatable shaft coupled to a hollow first cylinder which resides inside a fixed second cylinder and which has disposed and penetrating the surface thereof helical slots, said hollow first cylinder containing slidably therein an essentially tubular bolt which has transverse end pins that communicate with and slide through said slots, whereby rotation of said first rotatable shaft causes said hollow cylinder to rotate within said second cylinder and said pins are urged by said slots communicating therewith to cause said bolt to move reciprocatively within the hollow first cylinder.

* * * * *